US006003681A

United States Patent [19]

Wilbur et al.

[11] Patent Number: 6,003,681

[45] Date of Patent: Dec. 21, 1999

[54] OFF-BELT STABILIZING SYSTEM FOR LIGHT-WEIGHT ARTICLES

[75] Inventors: John H. Wilbur; Todd Hoffman, both of Medford, Oreg.

[73] Assignee: SRC Vision, Inc., Medford, Oreg.

[21] Appl. No.: 08/657,357

[22] Filed: Jun. 3, 1996

[51] Int. Cl.[6] ..... B07C 5/02

[52] U.S. Cl. ..... 209/639; 209/638

[58] Field of Search ..... 209/638, 639

[56] References Cited

U.S. PATENT DOCUMENTS

| | | | |
|---|---|---|---|
| 3,097,744 | 7/1963 | Hutter et al. | 209/639 X |
| 3,928,183 | 12/1975 | Asfour et al. | 209/639 |
| 4,018,674 | 4/1977 | Morris | 209/639 X |
| 4,630,736 | 12/1986 | Maughan et al. | 209/639 X |
| 5,048,674 | 9/1991 | Wilbur et al. | 198/836.2 |
| 5,297,667 | 3/1994 | Hoffman et al. | 198/493 |
| 5,482,166 | 1/1996 | Brown | 209/639 X |

FOREIGN PATENT DOCUMENTS

| | | | |
|---|---|---|---|
| 186259 | 7/1986 | European Pat. Off. | 209/639 |
| 298273 | 10/1992 | Japan | 209/638 |

*Primary Examiner*—William E. Terrell
*Assistant Examiner*—Patrick Mackey
*Attorney, Agent, or Firm*—Stoel Rives LLP

[57] ABSTRACT

A stabilizing system stabilizes light-weight articles carried on conveyors for automated bulk processing equipment. In a preferred embodiment, the light-weight articles, such as, for example, tobacco leaf products or wood chips, are moved and stabilized along a conveyor from a first infeed end to a second discharge end where they are projected in-air along a trajectory through an illumination station and sorting station. An enclosed off-belt housing is provided within which the light-weight articles are projected along a controlled trajectory to be processed by the optical inspection and sorting systems.

8 Claims, 8 Drawing Sheets

92
84
30
104
100
106
80
116
102
107
X
110
124
FROM
BLOWER
126
122
108
132
128
86
130
114
120
ACCEPT
94
DEFECT

OFF-BELT STABILIZING SYSTEM FOR LIGHT-WEIGHT ARTICLES

TECHNICAL FIELD

The present invention relates to conveyor systems for automated bulk processing equipment and, in particular, to systems for stabilizing light-weight articles carried by such systems.

BACKGROUND OF THE INVENTION

Automated bulk optical processing equipment can perform a variety of tasks such as, for example, inspecting or sorting bulk articles including raw or processed fruit, vegetables, wood chips, recycled plastics and other similar products. The articles may be characterized according to size, color, shape or other qualities. Modern bulk optical processing equipment can rapidly separate very large quantities of articles into numerous categories.

Such equipment typically includes a conveyor system that moves the articles past an inspection station where cameras or other detection devices examine the articles as they pass by a scan line. The inspection station sends signals to a sorting or treatment station where the articles are sorted or otherwise treated by category. For example, defective or foreign articles may be removed from the flow of articles carried by the conveyor system.

Rapid inspection or sorting of large quantities of articles typically requires high-speed conveyor systems such as, for example, conveyor belts with widths of 2–6 ft (0.6–1.8 m) and that carry articles at speeds of over 10 ft/sec (3 m/sec). A problem with conveyor systems driven at such speeds is that many articles are relatively unstable on the belts and tend to roll, tumble, bounce and collide with one another. Unstable articles carried by a high-speed conveyor system are difficult to inspect, sort or otherwise process for at least two reasons.

First, automated bulk optical processing equipment includes cameras or other optical detectors that optically determine selected characteristics of the articles (e.g., size, color or shape). The rolling, tumbling or bouncing of an article typically diminishes the clarity with which an image of the article is generated, thereby decreasing the accuracy and reliability of the optical information about the article. As extreme examples, rolling could cause a cubic article to appear round or an article with regions of two different colors to be of a single mixed color.

Second, unstable articles moving on a conveyor belt can move laterally across the belt or along the belt in its direction of travel. Lateral movement of the articles is undesirable because it misaligns the articles as they pass from the inspection station to the processing station, thereby resulting in incorrect processing. Similarly, articles that move along the belt in its direction of travel have different effective speeds along the belt and may be temporally misaligned for subsequent processing operations.

Some articles have increased susceptibility to unstable motion on a conveyor, such as light-weight articles and articles of low and non-uniform density. Examples of such articles include tobacco products such as stripped-leaf tobacco or laminae, ground tobacco stems, and re-claim. Other examples include wood chips. Yet other such light-weight articles might include debris such as, for example, feathers, paper or plastic wrappers or string that may incidentally be included within the acceptable articles. As a consequence, these types of articles are difficult to inspect and sort accurately at high speeds.

One attempt to solve such instability problems can be seen in U.S. Pat. No. 5,297,667 for a System For Stabilizing Articles On Conveyors, assigned to the assignee of this patent application. This device uses a hood located just above the belt to create a flow of gas (e.g., air) projected along the conveyor belt in a direction generally parallel to that in which the articles are carried by the belt. The air flow has a velocity substantially the same as that above the belt to reduce aerodynamic resistance that would otherwise bear against the articles causing them to become unstable. Since this resistance is reduced, the articles carried by the belt are relatively stable. The articles are accelerated by and propelled from the belt in-air along a known and predictable trajectory to a sorting or processing station. The successful operation of the sorter or processor depends on the fact that the products are propelled along the known trajectory. Thus, the processor notes the exact position of the articles as they pass by and can separate defective or undesirable articles from the volume of acceptable articles. This type of system has been successful for articles having a relatively high mass. Articles with high mass are able to maintain their velocity in-air as they are projected from the belt and continue along their predicted trajectory.

Another attempt to stabilize articles as they are moved along a conveyor belt is the use of a second counter-rotating conveyor belt located above and close to the conveyor belt on which the articles are positioned. Instead of blowing air through a hood that encloses the conveyor belt, the second counter-rotating conveyor belt creates a flow of air in a direction generally parallel to the direction of travel of the articles. The flow of air generated by the second counter-rotating conveyor belt has a velocity about the same as the article-conveying belt to reduce any aerodynamic resistance that would otherwise bear against the articles. One example of such a system is the Tobacco Scan 6000 manufactured by Elbicon located near Brussels, Belgium.

However, these systems are inadequate for very light articles such as the tobacco products described above, wood chips, light-weight debris or articles having a weight of between 1.5–5 pounds per cubic foot. Light-weight articles become unstable after they leave the belt and travel along an unknown trajectory. This happens because air flow becomes unstable after it leaves the belt. The air profile separates into a random flow pattern. A portion of the air flows downward while another portion flows straight. Yet other parts of the air may flow upward or in a direction transverse to the direction of travel of the belt. The light-weight articles do not have enough mass to continue along a predicted trajectory. They lose velocity and are drawn into a random air flow pattern. The positions of the articles cannot be predicted at a specific time. This makes accurate processing of the articles difficult and impractical.

Another problem with existing systems is inadequate illumination of the articles. In current systems, an illumination station includes light tubes to illuminate the articles. Clear plastic covers are placed over the light tubes to protect them from the articles as they are projected past the illumination station. This increases the distance between the light tubes and the articles. The distant placement of the light tubes from the articles may cause shadows to appear. The camera may improperly view the shadow as another article, thereby resulting in a miscalculation and improper processing. The light tubes cannot be placed directly over the scan line because they would block the camera's view of the articles. It is desirable to place the light tubes as close to or as collinear with the camera scan line as possible to reduce shadows.

SUMMARY OF THE INVENTION

An object of the present invention is, therefore, to provide an improved conveyor for use with automated bulk processing equipment.

Another object of this invention is to increase stability of light-weight articles as they are carried on and projected in-air from such conveyors.

A further object of this invention is to provide such a conveyor that is capable of allowing increased accuracy in optical processing of light-weight articles and articles of low and non-uniform density.

Another object of the invention is to provide a system with improved illumination of the articles.

The present invention includes an off-belt stabilizing system for stabilizing light-weight articles as they are projected in-air from a conveyor belt for automated bulk processing equipment. In a preferred embodiment, the light-weight articles are stabilized along a conveyor belt from a first infeed end to a second discharge end.

The off-belt stabilizing system provides a totally enclosed system that stabilizes the light-weight articles as they are projected in-air from the second discharge end of the conveyor belt. The air flow at and past the end of the belt is controlled so that light-weight articles that are projected within the air flow travel along a known and predictable trajectory.

Additionally, the present invention provides for improved illumination of the articles. This is achieved by incorporating the optical illuminating station and the sorting station into the off-belt stabilizing system. Windows are provided in the hood structure through which lighting units, preferably light tubes, can illuminate the articles as they pass by the cameras. The windows extend between the light tubes and the articles as they travel in-air along their trajectory. Thus, the light tubes can be located closer together to be as collinear as possible with the scan line.

Additional objects and advantages of the present invention will be apparent from the following detailed description of preferred embodiments thereof, which proceeds with reference to the accompanying drawings.

DETAILED DESCRIPTION OF PREFERRED EMBODIMENTS

Figure 1:
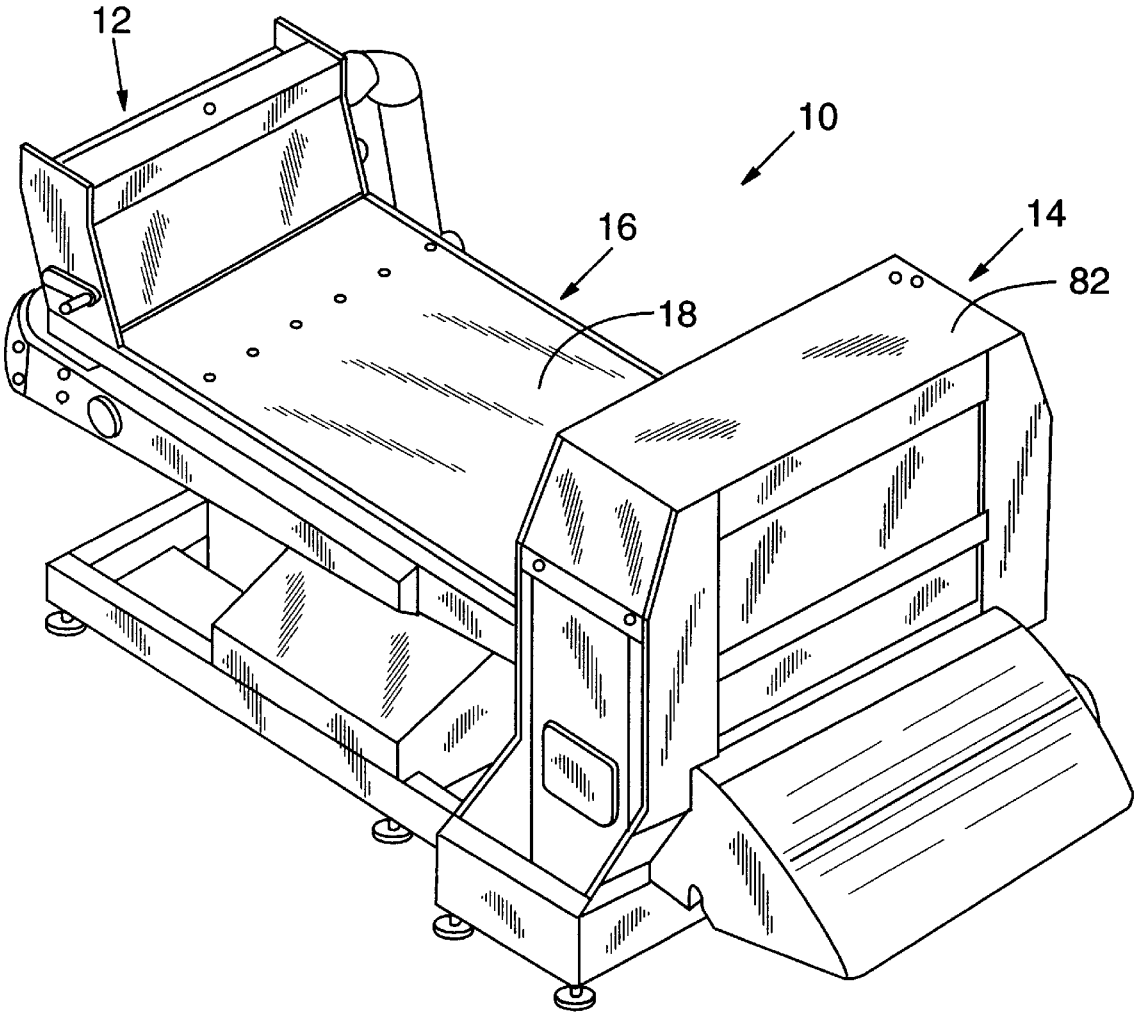
FIG. 1 is an isometric view of an automated bulk processing system with an off-belt stabilizing system of the present invention.
Figure 2:
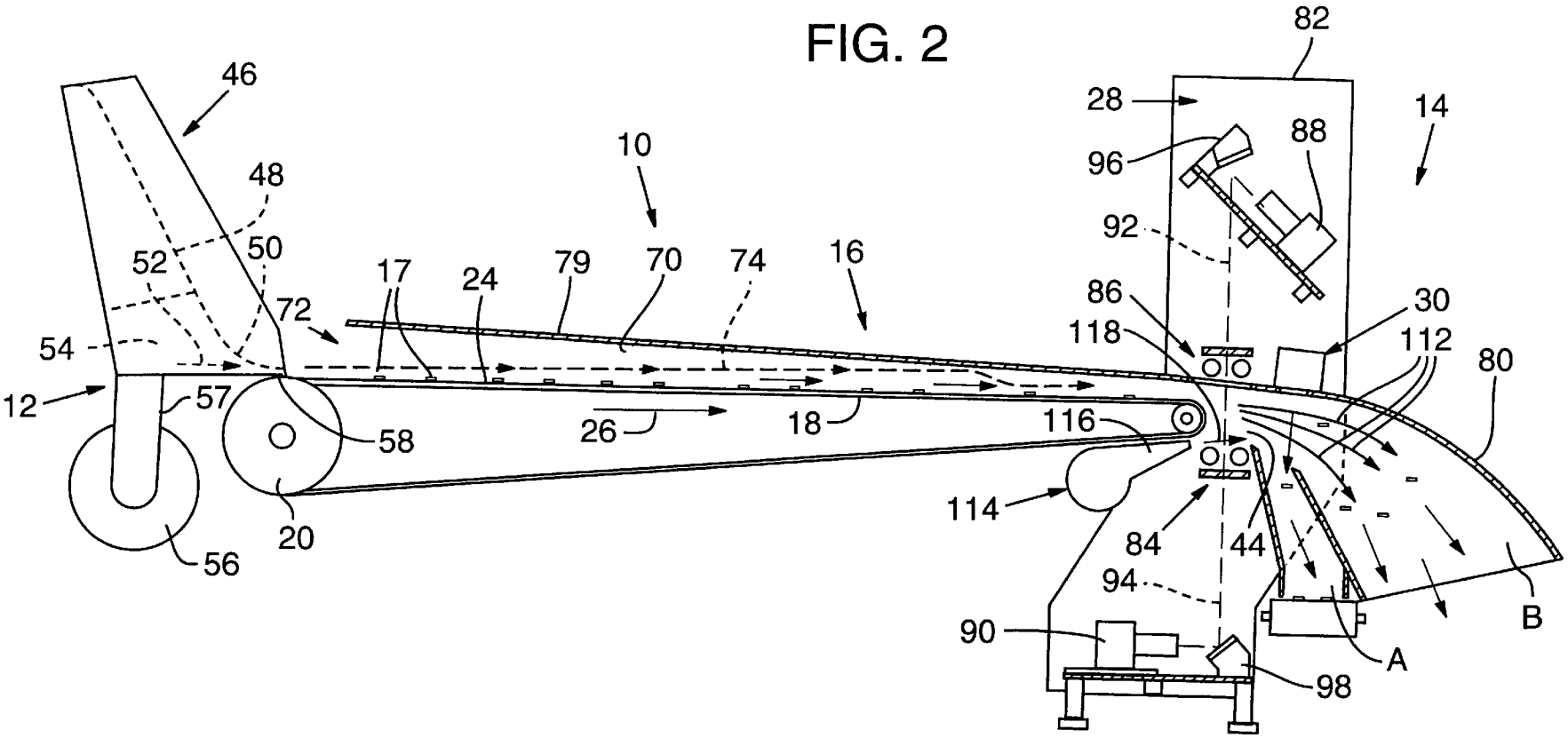
FIG. 2 is a schematic side view of the automated bulk processing system of FIG. 1.
Figure 3:
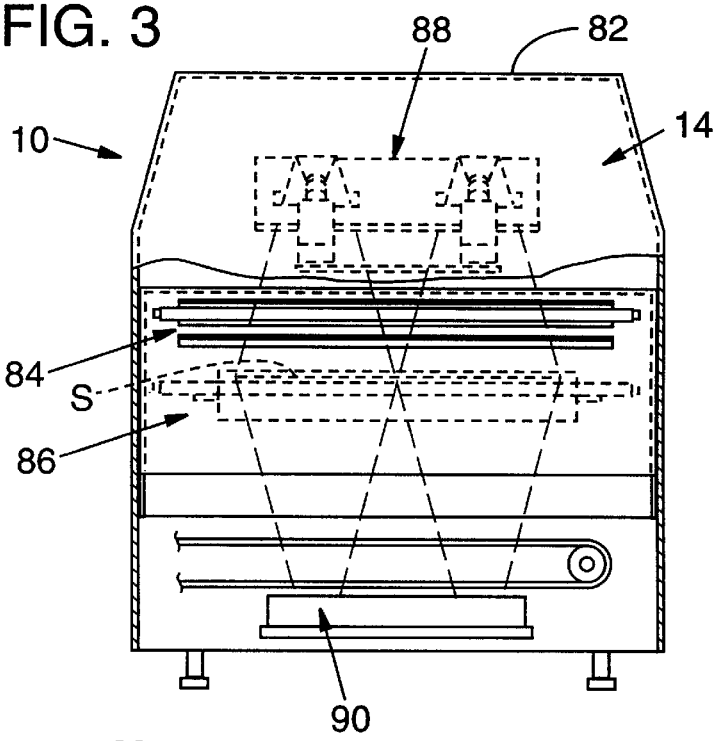
FIG. 3 is an end view of the automated bulk processing system of FIG. 1.

FIGS. 1–3 show an automated bulk optical processing system 10 having an on-belt stabilizing system 12 and an off-belt stabilizing system 14 of the present invention for stabilizing articles carried by a conveyor 16. Processing system 10 preferably performs optical inspection of large quantities of light-weight articles such as, for example, stripped-leaf tobacco or laminae, ground tobacco stems, re-claim, wood chips, or light-weight debris. It will be appreciated, however, that stabilizing systems 12 and 14 could be similarly employed by other types of automated processing equipment such as, for example, packaging systems.

Conveyor 16 includes any commercially available anti-static belt 18 known and used by those having ordinary skill in the art. This type of belt reduces any static charge that may develop during operation. Static charge in the belt may cause the articles 17 (FIG. 2) to adhere thereto and reduce the effectiveness of the system. The belt 18 forms a closed loop around a drive roller 20 and a spaced-apart, free-running end roller 22. A motor (not shown) coupled to drive roller 20 drives an upper surface 24 of belt 18 at a velocity in a direction 26 toward the off-belt stabilizing system 14 that includes an optical inspection station 28 and a sorting station 30.

Articles 17 are delivered to belt 18 by an infeed system 46. Infeed system 46 is shown as having a curved chute 48 down which articles slide to be accelerated to about the speed of belt 18. The articles slide off a lower end 50 of chute 48 and drop onto belt 18. Infeed system 46 could alternatively employ an infeed conveyor belt, inactive chute or a vibrating chute.

On-belt stabilizing system 12 helps to accelerate the articles dropping from chute 48 to the speed of belt 18 by generating a flow 52 of fluid, preferably a readily available gas such as air, that passes between belt 18 and lower end 50 of chute 48. Air flow 52 engages the articles as they drop from chute 48 onto belt 18 and functions to accelerate the articles to the velocity of belt 18. Air flow 52 has a velocity that may but need not equal the velocity of belt 18. After the articles are accelerated to the velocity of belt 18, air flow 52 functions to stabilize the articles on belt 18.

More specifically, the articles dropped onto belt 18 from chute 48 would typically bounce, tumble and roll, thereby requiring a length of belt 18 to allow the articles to settle into moderately stable positions thereon. Stabilizing system 12 settles the articles onto belt 18 much more quickly, thereby allowing belt 18 to be shortened and processing system 10 to be more compact or allowing conveyor 10 to increase product flow with the same stability and greater throughput of process.

Stabilizing system 12 employs a chamber or plenum 54 that receives air under pressure from a blower 56 via a conduit 57. A nozzle 58 in plenum 54 is positioned below and extends across chute 48 and belt 18 to provide a generally smooth flow 52 of air for stabilizing the articles. Belt 18 carries the articles to the off-belt stabilizing system 14 where they are processed.

Figure 4:
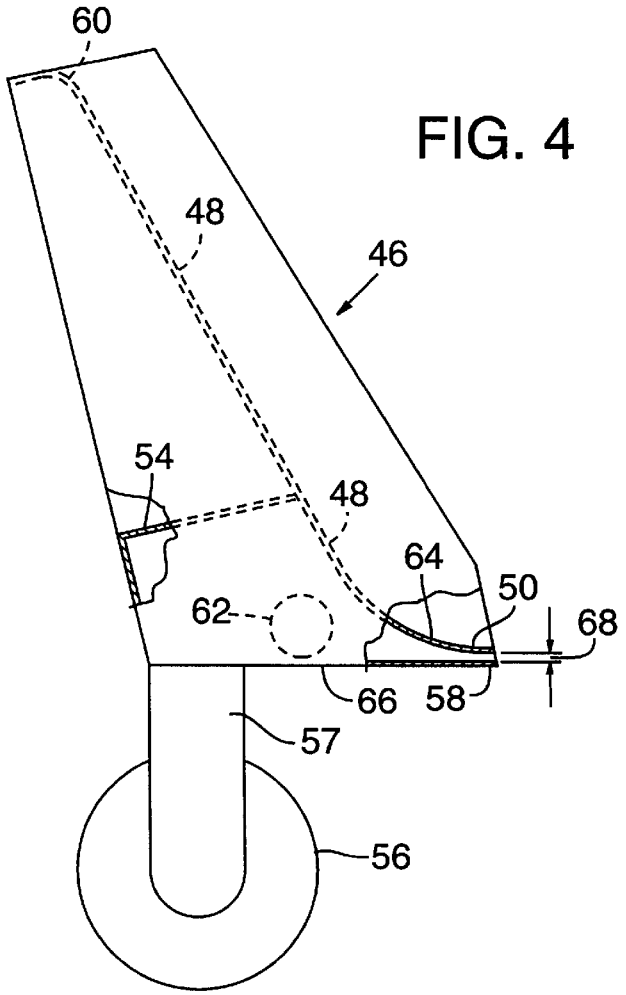
FIG. 4 is an enlarged sectional side view of an infeed chute and associated components of an on-belt second stabilizing system shown in FIG. 1.

FIG. 4 is a side view of infeed system 46, which receives the articles at a receiving end 60 of chute 48 from an infeed shaker (not shown). The articles are accelerated by gravity as they slide along chute 48 through a bend 64 toward lower end 50. Chamber or plenum 54 is positioned below chute 48 and receives air under pressure from blower 56. Bend 64 in chute 48 cooperates with a slanted bottom surface 66 of plenum 54 to form nozzle 58, which extends across the width of belt 18. In a preferred embodiment, nozzle 58 forms an opening with a height 68 of about 0.25 in (0.5 cm).

In order to further reduce static charge, ionized air is used to create the flow 52. Ionized air is created by passing the air in the plenum 54 across an ion bar 62 mounted in any desired fashion within the plenum 54. The ion bar 62 extends across the width of the belt 18 and is of the type known and used by those skilled in the art.

Although the specific infeed system 46 is shown and described, it is to be understood by those having ordinary skill in the art that the invention is not limited to the specific configuration shown and described and that other infeed systems could be used to introduce the light-weight articles onto a conveyor so that they have a velocity substantially the same as the velocity of the belt 18.

On-belt stabilizing system 12 further includes a tunnel 70 that generally encloses upper surface 24 of belt 18 from a tunnel entrance 72. Tunnel 70 allows stabilizing system 12 to generate a flow 74 of fluid, preferably a readily available gas such as air, that passes over and past the length of belt 18. Tunnel 70 is formed by a hood 79 positioned over and extending along belt 18.

It is to be understood by persons having ordinary skill in the art that any on-belt stabilizing system may be used to stabilize the light-weight articles on the conveyor belt. For example, a dual conveyor belt system such as the Tobacco Scan 6000 manufactured by Elbicon located near Brussels, Belgium, may be used that employs a counter-rotating conveyor belt located above the lower article-bearing conveyor belt. The counter-rotating conveyor belt creates a flow of air between the lower conveyor belt and the counter-rotating conveyor belt to stabilize the articles on the lower conveyor belt.

In a conventional conveyor system not employing an air assisted stabilizing system, only a very thin boundary layer of air travels at or near the speed of the conveyor belt. For a smooth conveyor belt, the boundary layer typically extends a few millimeters above the belt. Articles with thicknesses greater than a few millimeters extend through the boundary layer to slower or generally stagnant air. As a consequence, the articles or certain ones of them can be retarded by the slower-moving air, thereby destabilizing the articles on the belt and causing them to roll, tumble, bounce or collide with one another.

Air flow 52 induces an air draft along tunnel entrance 72 so that the articles carried on belt 18 are gradually stabilized by air flows of increasing velocity. Stabilizing system 12 stabilizes the articles carried on belt 18 so that they are substantially stable and travel at the speed of the belt toward the off-belt stabilizing system 14.

Off-belt stabilizing system 14 includes an end hood portion 80 (FIG. 5) that extends through the inspection station 28 and supports sorting station 30 to provide a closed environment for the articles as they leave belt 18.

Inspection station 28 includes a housing 82 that encloses a pair of upper and lower lighting units 84 and 86 and upper and lower camera modules 88 and 90 to identify selected optical characteristics of the articles as they pass from belt 18. Lighting units 84 and 86 are typically fluorescent tubes mounted within a mounting system (not shown) that may include, for example, tube sockets supported by a light source support connected to housing 82. Cameras 88 and 90 view the articles along respective lines of sight 92 and 94 through adjustable mirrors 96 and 98. Inspection station 28 can identify the preselected characteristics of the articles in accordance with the methods and systems described in U.S. Pat. No. 5,085,325 of Jones et al. for Color Sorting System and Method, assigned to the assignee of the present application.

Figure 5:
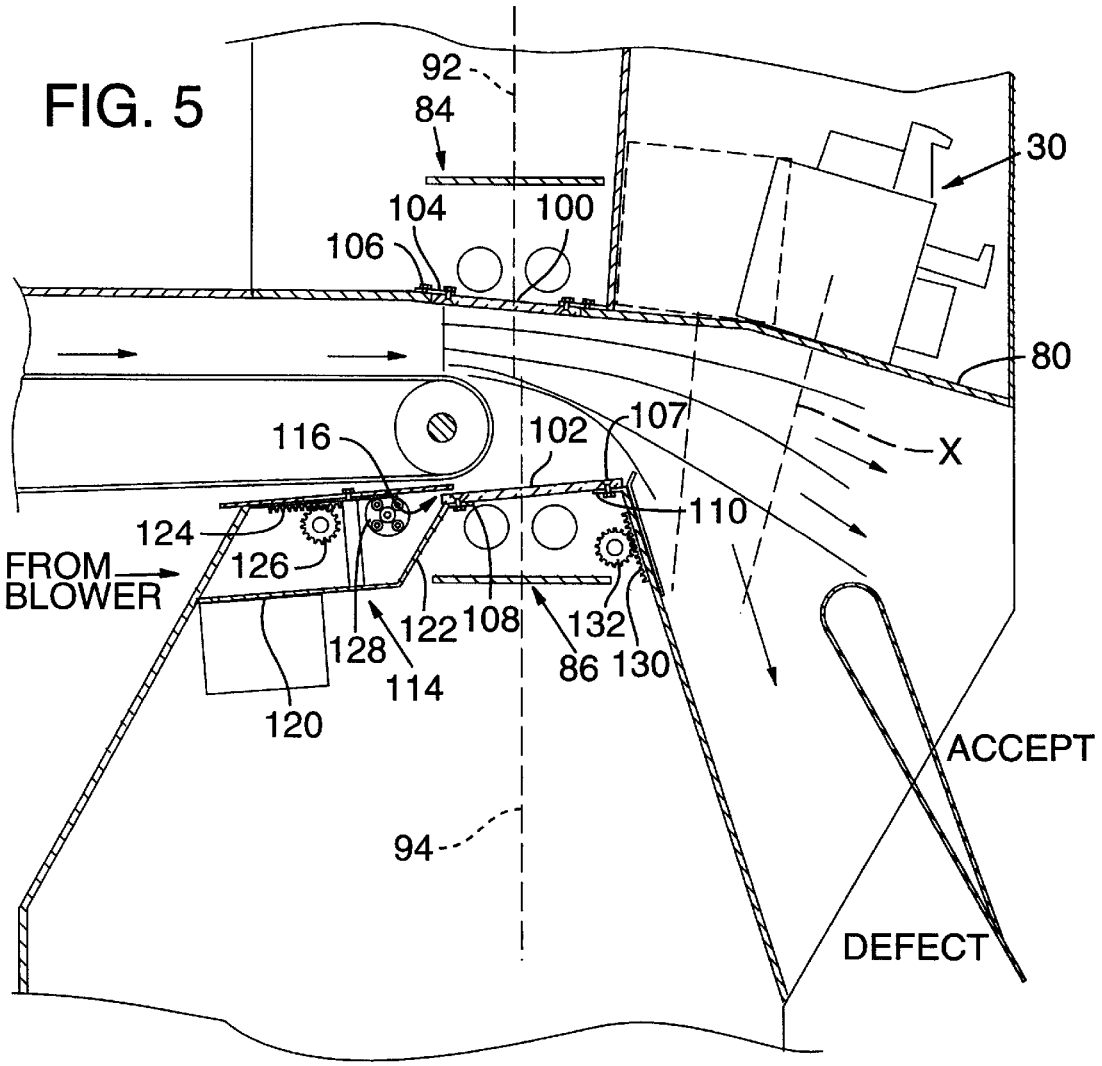
FIG. 5 is an enlarged schematic side view of the off-belt stabilizing system of the present invention.

As best seen in FIGS. 3–5, in order to illuminate the articles 17 as they pass through the off-belt system 14 and so that the cameras 88 and 90 can view the articles, upper and lower transparent windows 100 and 102 are mounted within the end hood portion 80. The windows may be constructed of any durable transparent material, such as, for example, glass or plastic. The upper window 100 may be mounted by brackets 104 and secured by fasteners 106. The lower window 102 may be secured by fasteners 107 to flanges 108 and 110 of the end hood portion 80. These windows protect the lighting units 84 and 86 from the articles 17 and from any other debris that may be included within the flow of articles. The lighting units 84 and 86 are located substantially close to the articles 17 and the lines of sight 92 and 94 without interfering with the field of view of the cameras 88 and 90. The cameras 88 and 90 view the articles along a horizontal scan line S (FIG. 3) extending perpendicular to the direction of travel of the belt 18. The scan line has a length substantially the same as the width of the belt 18. The light tubes are mounted to extend perpendicularly to the direction of travel of the belt 18 and are, therefore, parallel to the scan line. The light tubes cannot be exactly collinear with the scan line because they would block the view of the cameras 88 and 90. However, the light tubes are substantially more collinear with the scan line than has been possible in prior systems. Thus, improved illumination of the articles 17 is provided.

After the articles pass through inspection station 28, a sorting station 30 employs multiple "puff jets" X (FIG. 5) positioned across the width of the belt 18 to produce pressurized air directed through an access opening (not shown) in end hood portion 80 to divert selected (typically defective) articles projected along a normal trajectory 112 extending from belt 18. The articles may be diverted by sorting station 30 into a defect chute A, thereby allowing acceptable articles to be propelled into an acceptance chute B.

An air curtain unit 114 having an adjustable nozzle 116 is positioned below end roller 22 and directs a compensating air flow 118 toward normal trajectory 112. Air flow 118 functions to support relatively small or light-weight articles within normal trajectory 112 and prevents the light-weight articles from being drawn around and under roller 22 by turbulent air flow.

Figure 6:
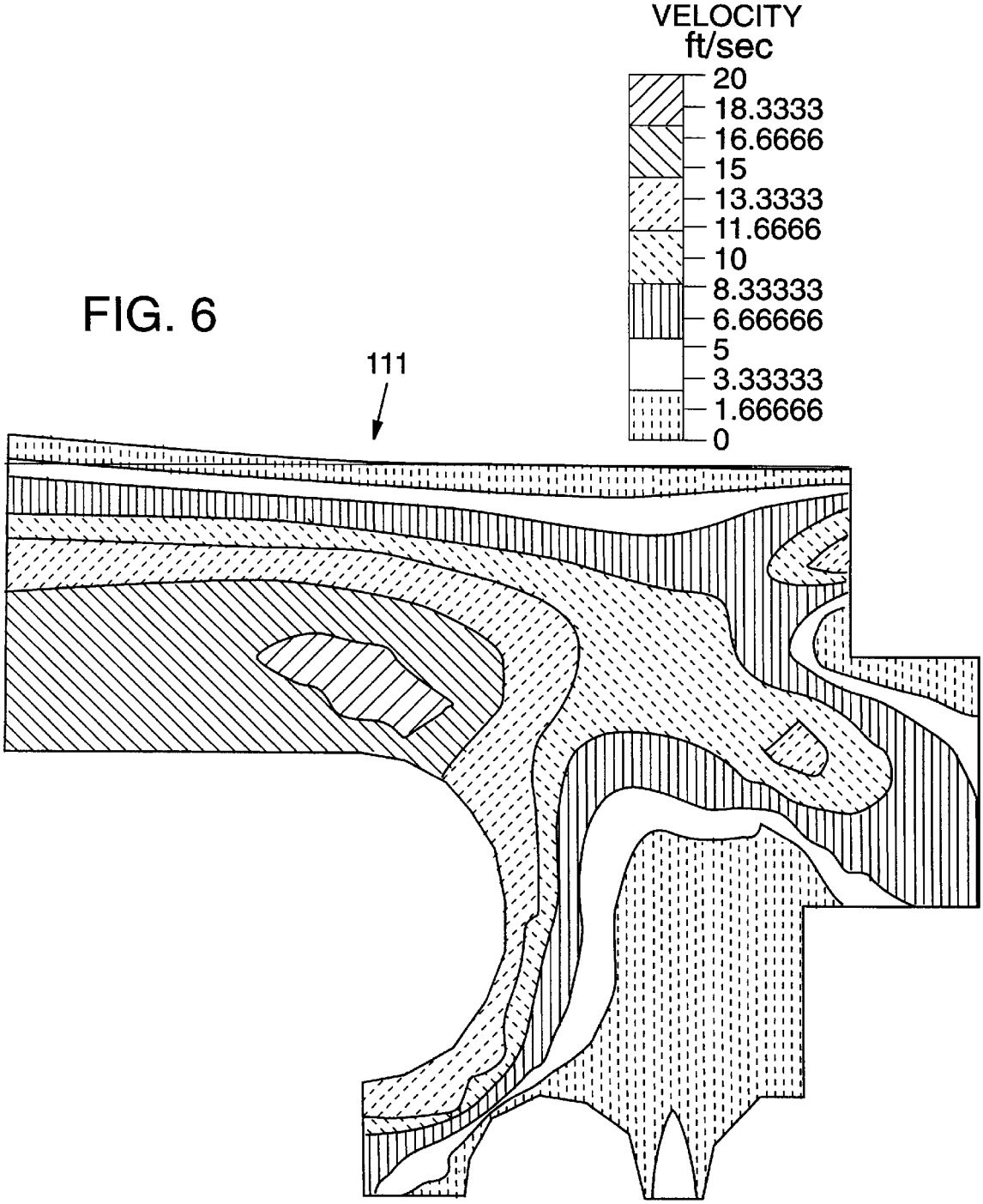
FIG. 6 is a computer-generated plot of air velocities at the end of the conveyor belt without an off-belt stabilizing system.
Figure 7:
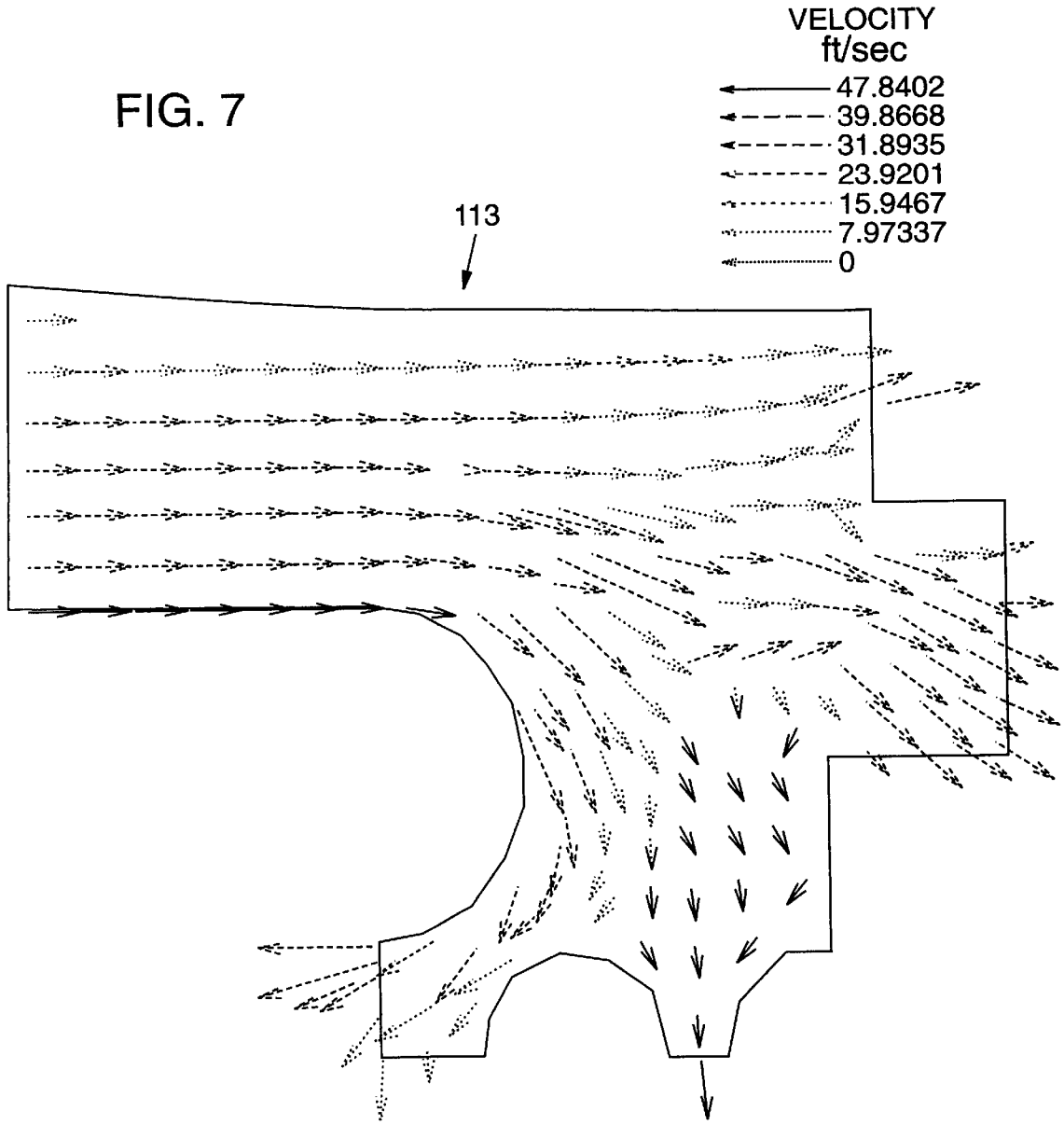
FIG. 7 is a computer-generated plot of air vectors at the end of the conveyor belt without an off-belt stabilizing system.

For example, as the belt 18 moves, an incidental boundary layer of air moves with it as the belt 18 passes downward around end roller 22. This can be seen in FIGS. 6 and 7, which show computer-generated plots of velocities, respectively, of air flow 111 and air flow vectors 113. These plots were generated with finite element analysis software for computational fluid dynamics to represent belt 18 driven at a speed of 15 ft/sec. (4.5 m/sec.).

These plots show that the air that travels away from the belt slows down. As the air slows, it develops a random or turbulent flow pattern. However, the boundary layer of moving air remains near the belt and can direct smaller and lighter-weight articles out of normal trajectory 112 down and around the roller 22. Light-weight articles that do not have enough mass to continue along a desired predicted path after they leave the belt can get caught up in the turbulent air flow. These light-weight articles either get pulled down and around the roller 22 or travel along unpredictable paths, thereby resulting in inaccurate processing. The air curtain unit 114 helps stabilize the articles to enable the system to more accurately process the articles.

The air curtain 114 has a housing 120 (FIG. 5). The top 122 of the housing is horizontally adjustable by a rack 124 and pinion 126 which may be rotated either manually or by a motor (not shown). This adjustment varies the nozzle opening 116 through which the air is directed and allows control of the air flow. The air flow also acts to clean the lower window 102 of any debris or dust. Additionally, to prevent static charge from building up on the lower window 102, an ion bar 128 similar to ion bar 62 employed within plenum 54 is located within the air curtain 114.

The air flow from the air curtain is further controlled by a second rack 130 and pinion 132. Pinion 132 may be rotated either manually or by a motor (not shown) to selectively or lower a sidewall 134 of the hood 80 to direct to flow of air up toward the articles.

Air flow 118 formed by air curtain unit 114 compensates for or offsets the effect of the incidental boundary layer on smaller or lighter-weight articles to improve the sorting accuracy of sorting station 30. In addition, air flow 118 reduces the amount of dust carried by the boundary layer of flowing air toward lighting units 84 and 86 and along belt 18, thereby improving the cleanliness and efficiency of both the lighting units and the windows.

In a preferred embodiment, processing system 10 processes tobacco leaf products, wood chips, or debris with belt 18 having a width of 2–6 ft (0.6–1.8 m) and driven at a speed of up to 1500 ft/min (7.6 m/sec). Stabilizing system 12 with nozzle 50 having a height of 0.25 in. (0.006 m) through which air flow 52 is driven at 10,000 ft/min (50.8 m/sec) displaces about 850 $ft^3$/min (24.1 $m^3$/min) (standard). Air curtain unit 114 with nozzle 116 having an opening height of 0.125 in (0.32 cm) through which air flow 118 moves up to 6000 ft/min (30 m/sec) displaces 276 $ft^3$/min (7.82 $m^3$/min) (standard).

As the articles leave the belt 18 they are completely enclosed within the end hood portion 80 as they are projected past the illumination station 28 and sorter station 30. The articles through an open-ended of-conveyor region confined within defined boundaries enclosed within the end hood portion 80 and the adjustability of the air flow produced by the air curtain 114 keep the velocity of the articles more uniform. In the preferred embodiment, upper and lower transparent windows 100 and 102 form a portion of the defined boundaries, as shown in FIG. 5. Thus, the articles travel along a more predictable trajectory resulting in a more accurate and efficient processing of the articles.

Figure 8:
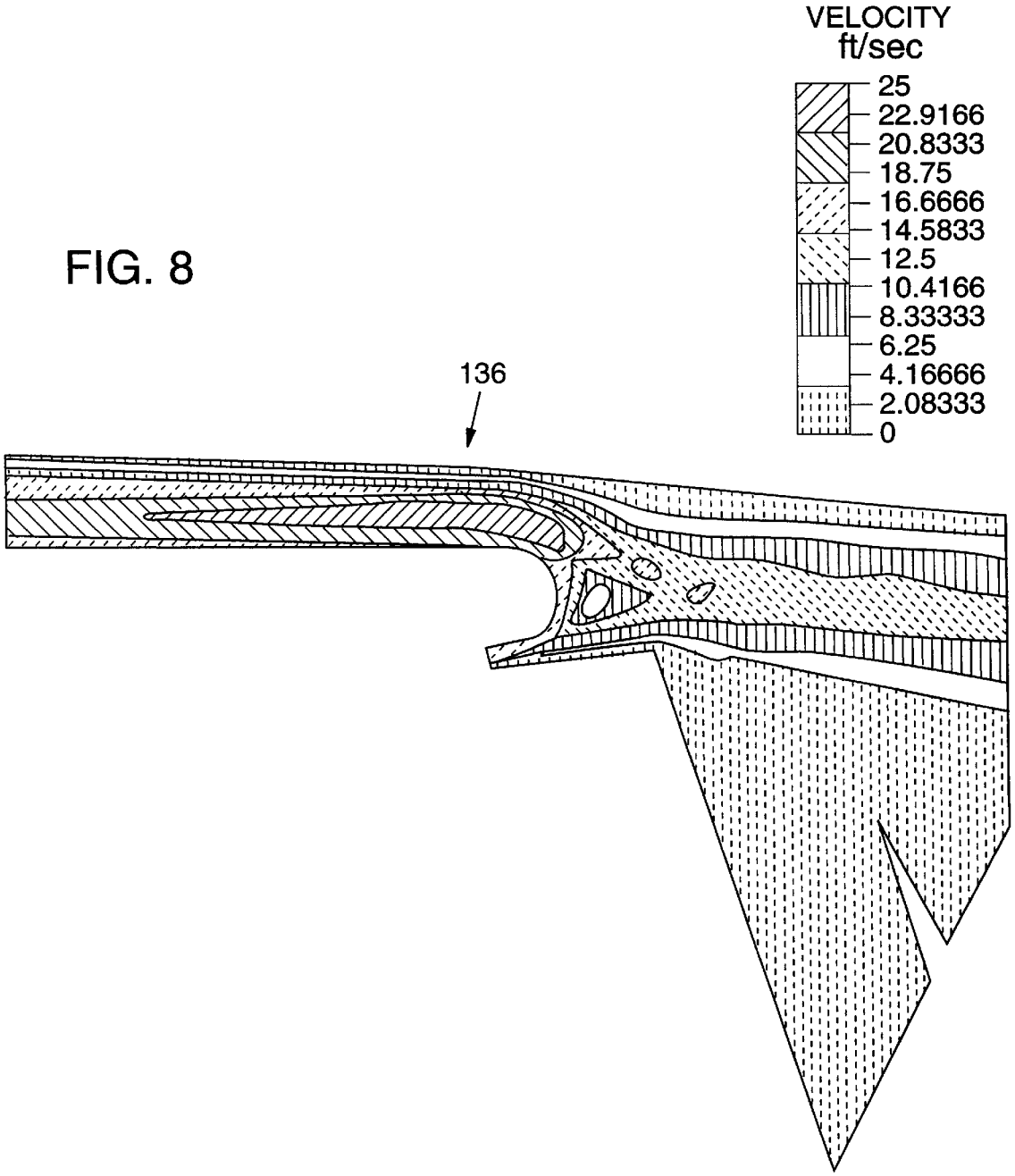
FIG. 8 is a computer-generated plot of air velocities within a stabilizing tunnel of an off-belt stabilizing system of the present invention.
Figure 9:
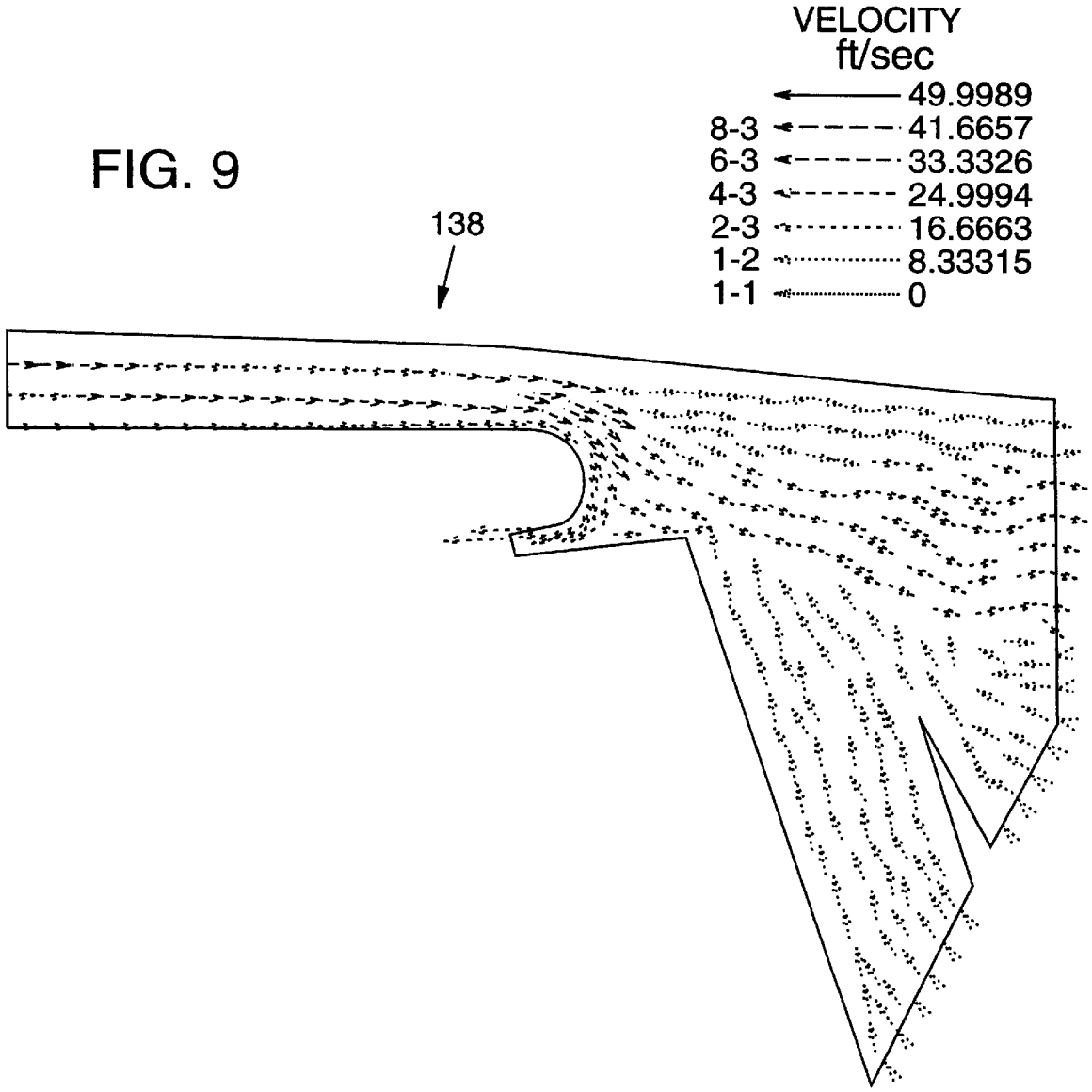
FIG. 9 is a computer-generated plot of air vectors within a stabilizing tunnel of an off-belt stabilizing system of the present invention.

FIGS. 8 and 9 are computer-generated plots of velocities 136 and vector paths 138 of air flow within tunnel of off-belt stabilizing system 14. These plots were generated with finite element analysis software for computational fluid dynamics to represent belt 18 driven at a speed of up to 17 ft/sec (5.18 m/sec). These conditions represent an exemplary preferred embodiment in which processing system 10 processes tobacco leaf products or wood chips.

These plots show that the air flow pattern within the off-belt stabilizing system 14 is more laminar and thus more predictable than in prior systems. Thus, the sorter station 30 can more accurately process the articles.

It will be obvious to those having skill in the art that many changes may be made to the details of the above described preferred embodiments of the present invention without departing from the underlying principles thereof. For example, the stabilizing system of the present invention could employ gases other than air as well as fluids other than gases. The scope of the present invention should, therefore, be determined only by the following claims.

We claim:

1. In an automated bulk processing system that includes inspection and sorting stations for optical inspection and sorting of light-weight articles, an air stream carrying the light-weight articles for processing by the inspection and sorting stations and, because of their light weight, the light-weight articles tending to travel along unpredictable trajectories that prevent reliable position tracking of The light-weight articles as they travel between the inspection and sorting stations and thereby adversely affect accurate and efficient processing, a method of providing a predictable trajectory for the light-weight articles to improve processing accuracy and efficiency as they undergo inspection and sorting, comprising:

conveying the light-weight articles along a path having an infeed end and a discharge end;

stabilizing the light-weight articles as they are conveyed along the path from the infeed end to the discharge end;

discharging the light-weight articles from the discharge end along an air stream within an open-ended off-conveyor region through which the light-weight articles pass for inspection and sorting, the air stream carrying the light-weight articles and developing proximal to the discharge end in the open-ended off-conveyor region a turbulent air flow pattern the effect of which would be to disturb the air stream and thereby cause the light-weight articles to travel along unpredictable paths;

confining the open-ended off-conveyor region within defined boundaries; and introducing into the open-ended off-conveyor region proximal to the discharge end a compensating air flow that substantially prevents the effect of the turbulent air flow pattern, the defined boundaries confining the open-ended off-conveyor region and the compensating air flow co-acting with the air stream to constrain the light-weight articles such that the air stream carries them along a predictable trajectory for accurate and efficient processing as they undergo inspection and sorting.

2. The method of claim 1, further comprising:

providing at least one optically transparent window within the open-ended off-conveyor region to form a portion of the defined boundaries; and directing light rays through each optically transparent window forming a portion of the defined boundaries to illuminate the light-weight articles carried by the air stream.

3. The method of claim 2 in which the conveying light-weight articles along a path is performed by a belt conveyor having a discharge end roller and the compensating air flow comprises an air curtain that is introduced into the open-ended off-conveyor region in a direction that prevents the light-weight articles from being drawn around and under the discharge end roller by the turbulent air flow pattern.

4. The method of claim 1 in which the conveying light-weight articles along a path is performed by a conveyor having an article-carrying surface and in which the defined boundaries of the open-ended off-conveyor region are formed in part by first and second spaced-apart optically transparent windows having major interior window surfaces positioned on either side of the predictable trajectory.

5. The method of claim 4 in which the first and second windows have major exterior window surfaces and further comprising first and second video cameras in proximal position to the major exterior window surfaces of the first and second windows, respectively.

6. The method of claim 1 in which the inspection and sorting stations include, respectively, a video camera having a line of sight and an ejector selectively emitting pressurized air along a path and in which a distance separates the line of sight from the path of pressurized air and defines a length of the open-ended off-conveyor region in which the air stream carries the light-weight articles along the predictable trajectory.

7. An automated bulk processing system that includes inspection and sorting stations for optical inspection and sorting of light-weight articles, comprising:

a conveyor having an infeed end and a discharge end and moveable to carry light-weight articles from the infeed end to the discharge end, the conveyor producing an air stream carrying the light-weight articles past inspection and sorting stations positioned downstream of the discharge end and within an open-ended off-conveyor region for processing, and because of their light weight, the light-weight articles tending to travel along unpredictable trajectories that prevent reliable position tracking of the light-weight articles as they travel between the inspection and sorting stations and thereby adversely affect accurate and efficient processing;

an air curtain unit directing into the off-conveyor open-ended region a compensating air flow intersecting the air stream; and an off-belt stabilizing system confining the open-ended off-conveyor region within defined boundaries on opposite sides of the air stream, the defined boundaries confining the open-ended off-conveyor region and the compensating air flow co-acting with the air stream to constrain the light-weight articles such that the air stream carries them along a predictable trajectory for accurate and efficient processing as they undergo inspection and sorting.

8. The system of claim 7 in which the inspection station comprises:

devices for illuminating and viewing the light-weight articles as they travel along the predictable trajectory within the open-ended off-conveyor region; and at least one transparent window through which the devices illuminate and view the light-weight articles and positioned to confine the open-ended off-conveyor region.

* * * * *